US005218149A

United States Patent [19]

Tanaka et al.

[11] Patent Number: 5,218,149

[45] Date of Patent: Jun. 8, 1993

[54] BODY UNIT FOR A STRING MUSICAL INSTRUMENT

[76] Inventors: Yuuji Tanaka; Hideyuki Ezaki, both of 10-1, Nakazawa-cho, Hamamatsu-shi, Shizuoka-ken, Japan

[21] Appl. No.: 745,524

[22] Filed: Aug. 15, 1991

[30] Foreign Application Priority Data

Aug. 28, 1990 [JP] Japan ..... 2-90606[U]

[51] Int. Cl.[5] ..... G10D 1/08

[52] U.S. Cl. ..... 84/291

[58] Field of Search ..... 84/290–292, 84/743

[56] References Cited

U.S. PATENT DOCUMENTS 4,359,923 11/1982 Brunet ..... 84/291 X
4,745,837 5/1988 Rimsa ..... 84/291
4,829,870 5/1989 Ralston ..... 84/291
5,029,511 7/1991 Rosendahl ..... 84/743
5,033,353 7/1991 Fala et al. ..... 84/743 X

*Primary Examiner*—William M. Shoop, Jr.
*Assistant Examiner*—Jeffrey W. Donels
*Attorney, Agent, or Firm*—Sachs & Sachs

[57] ABSTRACT

In construction of a body unit for a string musical instrument such as an electric guitar, a planar pattern panel bearing a fashionable graphic design is interchangeably sandwiched between a body top of the musical instrument and a substantially transparent cover panel detachably coupled to the body top. Aesthetic properties of the musical instrument can be easily adjusted by an individual user without any assistance by professionals in accordance with personal preference and/or situation in performance by interchanging the pattern panel.

6 Claims, 5 Drawing Sheets

BODY UNIT FOR A STRING MUSICAL INSTRUMENT

BACKGROUND OF THE INVENTION

The present invention relates to a body unit for a string musical instrument, and more particularly relates to improvement in aesthetic effect on a body unit for a string musical instrument such as an electric guitar.

String musical instruments such as electric guitars and electric bases have broadly permeated into the market of young generations in these days. In order to well excite young people's interest in purchase, these string musical instruments are now required to have, in addition to excellent acoustic faculties, highly fashionable, eye-catching aesthetic properties. Based on such a background in the art, various graphic designs are recently applied to the body of a string musical instrument.

In the case of a conventional acoustic string musical instrument, a hollow or semi-hollow body is generally employed in which a resonant chamber is defined by its body top, a side and a back. Whereas an electric string musical instrument is generally provided with a solid body on which various tone generating elements such as pick-ups are arranged. In either case, graphic designs are applied directly to the body top by means of painting or printing.

In use of a string musical instrument, in particular in the case of commercial use, it is often wanted by players to change the graphic designs on the body top in accordance with personal preference and/or situation of performance. It is, however, very difficult for individual users to change the graphic design once applied to the body top at the phase of production. Even when possible with assistance by professionals, such a change entails high cost for reformation. Aside from possibility in design change, generally hectic performance of string musical instrument tends to mar the graphic design directly appearing on the surface of the body top. Even use of a special pick-up guard does not assure full protection on the graphic design appearing on the body top.

SUMMARY OF THE INVENTION

It is thus the primary object of the present invention to enable, without any significant rise in cost, easy and free change in graphic design on the body top of a string musical instrument by individual users in accordance with personal preference and/or situation of performance.

It is the other object of the present invention to provide a perfect protection on graphic designs applied onto the body top of a string musical instrument.

In accordance with the basic aspect of the present invention, at least one planar pattern panel is interchangeably inserted between a body top of a string musical instrument and a substantially transparent cover panel detachably coupled to the body top.

DESCRIPTION OF THE PREFERRED EMBODIMENTS

Figure 1:
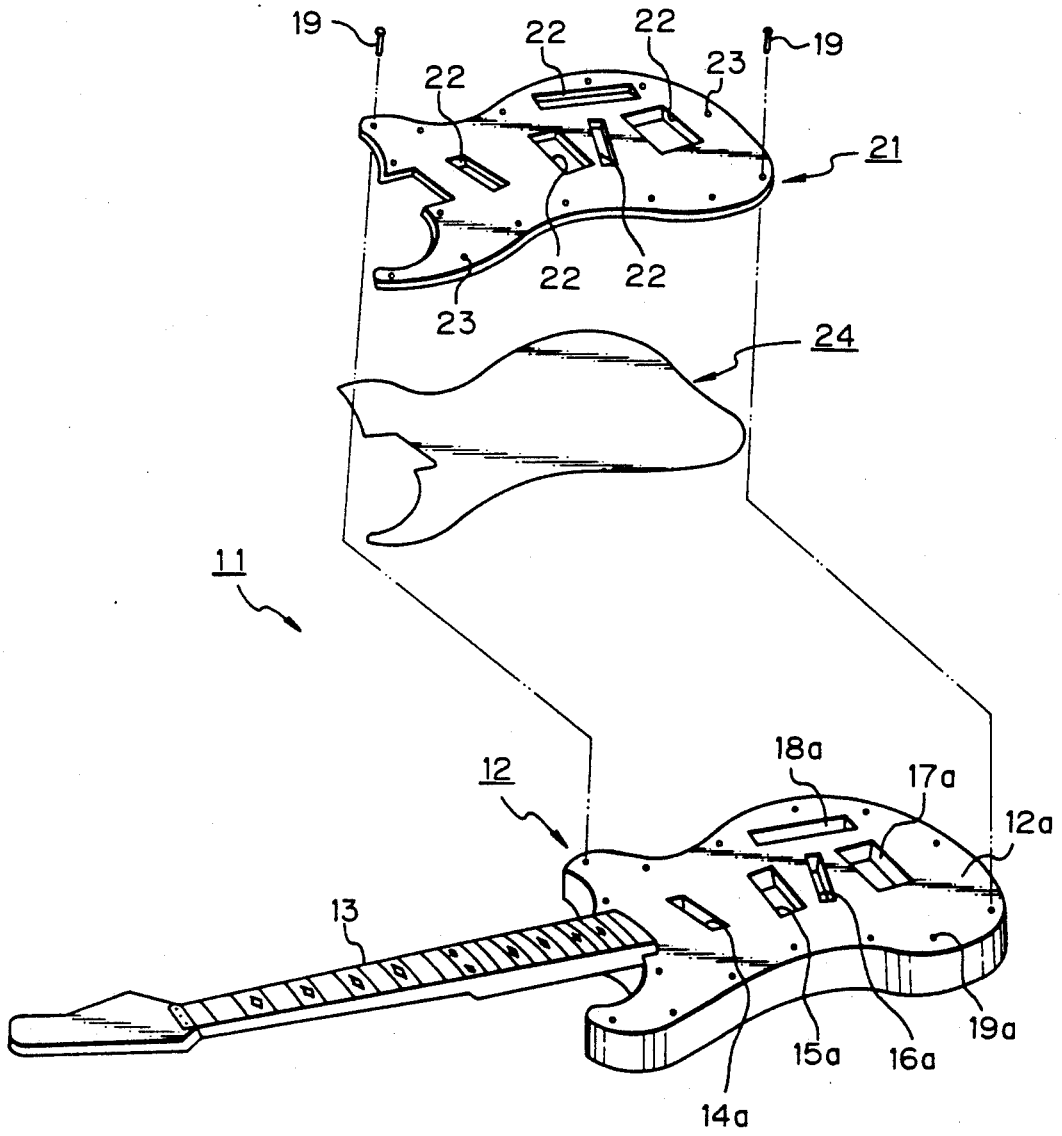
FIG. 1 is a perspective plan view of one embodiment of a body unit in accordance with the present invention in a disassembled state.
Figure 2:
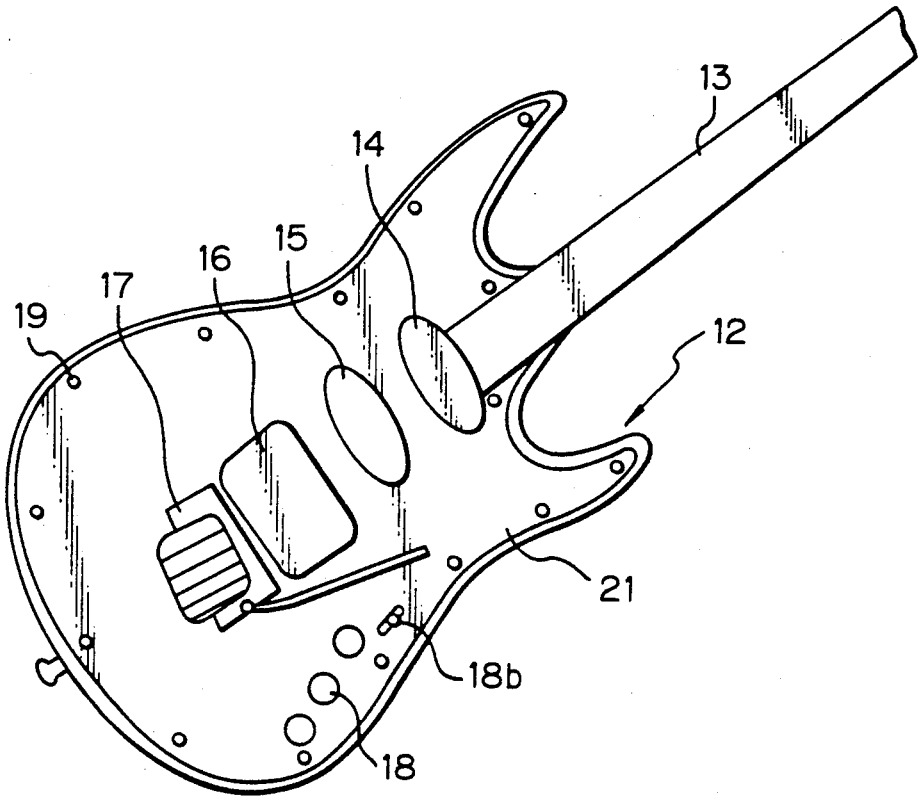
FIG. 2 is a top plan view of the body unit.
Figure 3:
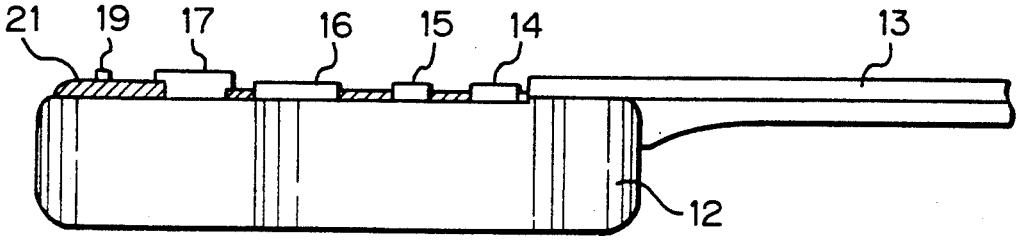
FIG. 3 is a side plan view of the body unit.

One embodiment of the body unit in accordance with the present invention is shown in FIGS. 1 to 3, in which the body unit 11 in accordance with the present invention is used for an electric guitar. As stated above, the body unit 11 is made up of a body 12 carrying a neck 13 coupled to one end thereof, a cover panel 21 and a pattern panel 24 be sandwiched in between the body 12 and the cover panel 21.

Figure 4:
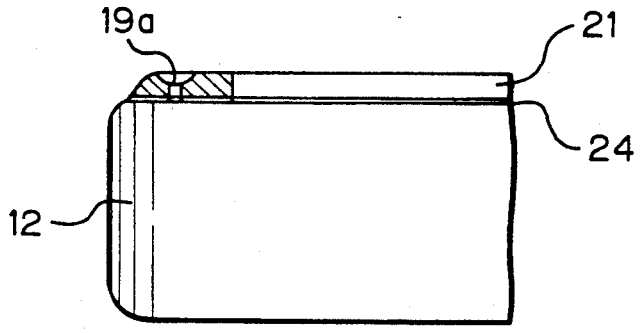
FIG. 4 is an enlarge side plan view, partly in section, of a part of the boy unit.

The body 12 is made of, for example, wood and its body top 12*a* is provided with recesses 14*a* to 18*a* adapted for receiving pick-ups 14 to 16. A tremolo unit 17 and a volume control 18. These elements are involved in generation of musical tones form the electric guitar. A plurality of threaded holes 19*a* are formed in the body top 12*a* along its periphery for engagement with fastener screws 19 used for detachably securing the cover panel 21 to the body 12 (see FIG. 4).

The cover panel 21 has contours substantially similar to that of the body top 12*a*. The cover panel 21 is made of a transparent or opaque material such as acrylic resin. The outermost contour of the cover panel 21 is somewhat smaller than that of the body top 12*a*. A plurality of through holes 23 are formed in the cover panel 21 for passage of the fastener screws 19.

Preferably, the thickness of the body 12 should be chosen smaller than that of a conventional body 12 without attachment of the cover panel 21, by an amount equal to-the thickness of the cover panel 21, and the thicknes of the neck 13 should be increased by same amount. In this way, the level of strings with respect to the tone generating elements on the body top 12*a* and the frets on the neck 13 can be maintained unchanged from that on a conventional electric guitar.

Figure 6A:
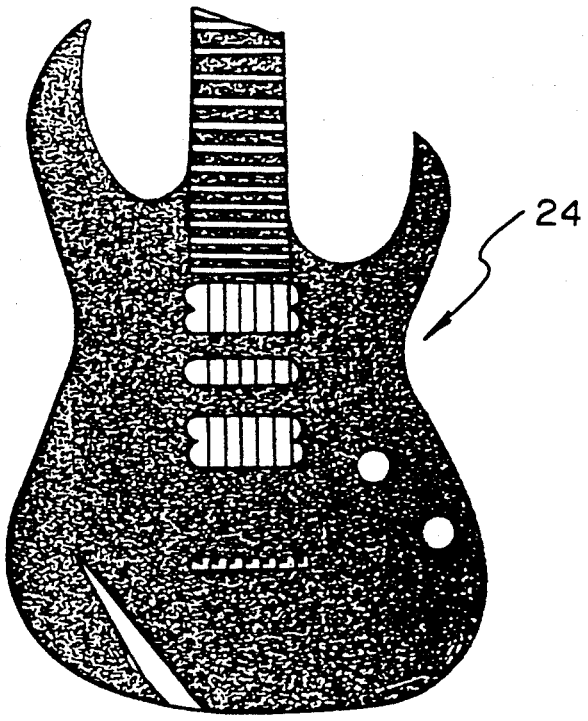
FIGS. 6A to 6C are top plan view of various graphic designs appearing on the body top of the body unit in accordance with the present invention.
Figure 6B:
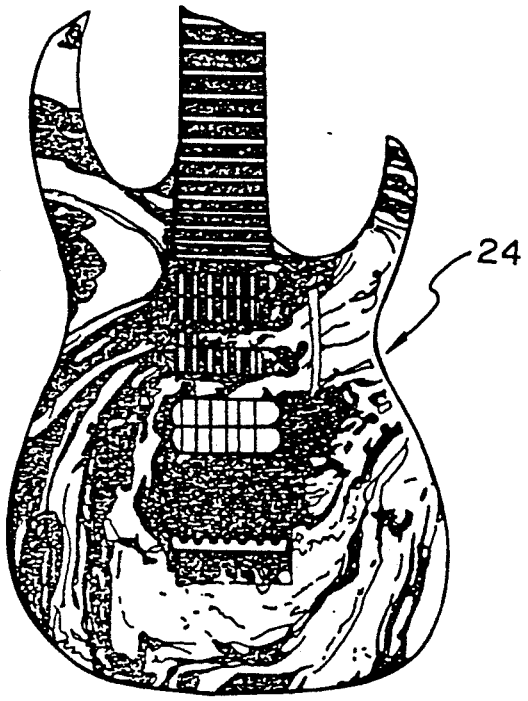
Figure 6C:
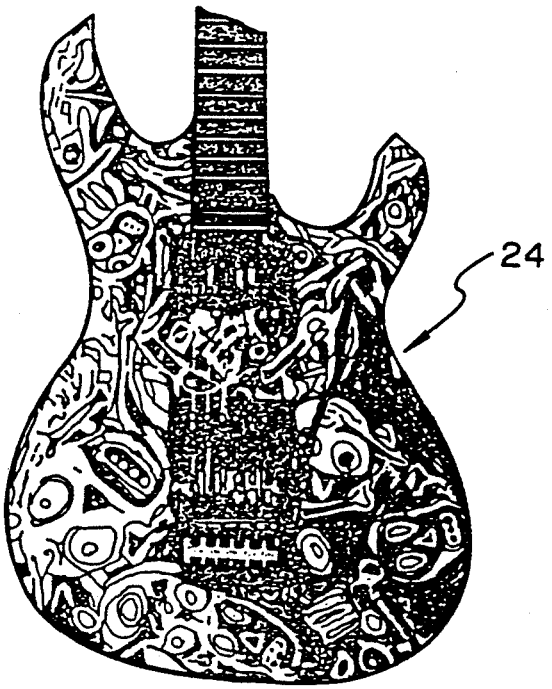

The pattern panel 24 is adapted for bearing graphic designs and preferably similar in contour to the body top 12*a* and the cover panel 21. Though not shown in the illustration, the pattern panel 24 is provided with through holes and openings for passage of the tone generating elements on the body top 12*a* and the fastener screws 19. Some examples of fashionable graphic designs to be born by the pattern panel 21 are shown in FIGS. 6A to 6C.

With the above-described construction of the body unit 11 in accordance with the present invention, a user is allowed to disassemble the body unit 11in order to freely interchange the pattern panel 24 in accordance with his personal preference and/or situation of performance. Such disassembly can be carried out quite easily by loosening the fastener screws 19 without any assistance by professionals. In addition, the graphic design on the pattern panel 24 is fully protected by the cover panel 21 against any attack encountered during performance and/or transportation.

Though only one pattern panel 24 is used for the illustrated example, two or more pattern panels 24 can be used in superimposed combination. Further, the contour of the pattern panel 24 may be somewhat different from that of the cover panel 21.

Figure 5:
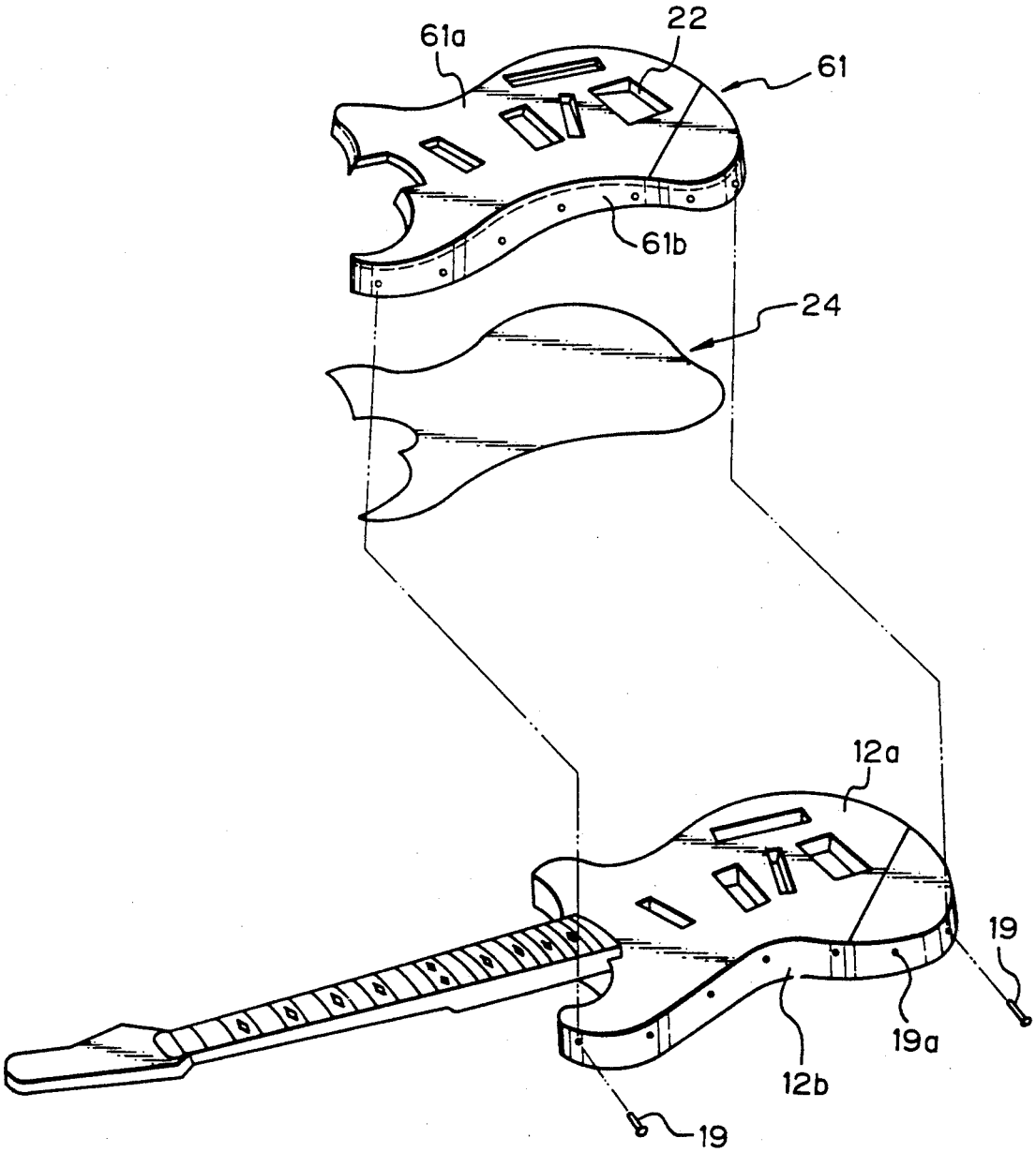
FIG. 5 is a perspective plan view of another embodiment of a body unit in accordance with the present invention in a disassembled state.

Another embodiment of the body unit in accordance with the present invention is shown in FIG. 5 in which the construction of the cover panel is somewhat different from that shown in FIG. 1. More specifically, the cover panel 61 of this embodiment is made up of a planar section 61*a* and a side wall section 61*b*. Like the foregoing embodiment, the planar section 61*a* is provided with through holes and openings for passage of the tone generating elements on the body top 12*a* and the fastener screws 19. The contour of the planar section 61 is somewhat larger than that of the body top 12*a* and the height of the side wall section 61*b* is roughly equal to that of the side wall of the body 12.

When assembled, the cover panel 61 wholly covers the body 12 of the electric guitar. So even when some inclination is present on the body top 12*a*, the intervening pattern panel 24 can be held reliably between the cover panel 61 and the body 12 thanks to the presence of the side wall section 61*b* of the cover panel 61 mating the side wall of the body 12.

Needless to say, the body unit of the present invention is usable for not only electric guitars but also other types of string musical instruments without any substantial change in design.

We claim:

1. A body unit for a string musical instrument comprising a body having a body top provided thereon with tone generating elements, a substantially transparent cover panel which is substantially similar in contour to said body top and provided with openings receptive of said tone generating elements on said body top, means for detachably coupling said cover panel to said body, and at least one pattern panel inserted between said body top and said cover panel.

2. A body unit as claimed in claim 1 in which said cover panel is made up of a planar section adapted for covering said body top and a side wall section adapted for covering the side wall of said body.

3. A body unit as claimed in claim 1 in which the thickness of said body is smaller than that of the body of a conventional body unit by an amount equal to the thickness of said cover panel.

4. A body unit as claimed in claim 2 in which the thickness of said body is smaller than that of the body of a conventional body unit by an amount equal to the thickness of said cover panel.

5. A body unit for a string musical instrument comprising a body having a body top provided thereon with tone generating elements, a pattern panel for decorating said body, a cover panel for holding said pattern panel adjacent to said body, said cover panel being similar in contour and size to said body top and substantially transparent for visual access to said pattern pane therethrough, and means for detachably coupling said cover panel to said body.

6. A body unit as claimed in claim 5 in which said cover panel is substantially similar in contour to said body top and provided with openings receptive of said tone generating elements on said body.

* * * * *